US007343643B2

(12) United States Patent
Kondo

(10) Patent No.: US 7,343,643 B2
(45) Date of Patent: Mar. 18, 2008

(54) SELECTIVE BAG OR BAGLESS CLEANING SYSTEM

(75) Inventor: Yasushi Kondo, Okayama (JP)

(73) Assignee: Panasonic Corporation of North America, Secaucus, NJ (US)

( * ) Notice: Subject to any disclaimer, the term of this patent is extended or adjusted under 35 U.S.C. 154(b) by 714 days.

(21) Appl. No.: 10/802,966

(22) Filed: Mar. 17, 2004

(65) Prior Publication Data

US 2004/0181898 A1 Sep. 23, 2004

Related U.S. Application Data

(60) Provisional application No. 60/455,317, filed on Mar. 17, 2003.

(51) Int. Cl.
*A47L 9/16* (2006.01)

(52) U.S. Cl. ..... 15/353; 15/352; 15/347; 55/DIG. 3; 55/337; 55/429

(58) Field of Classification Search ..... 15/327.1, 15/327.2, 327.3, 327.4, 327.5, 327.6, 327.7, 15/347, 350–353; 55/337, 429
See application file for complete search history.

(56) References Cited

U.S. PATENT DOCUMENTS

| | | | | |
|---|---|---|---|---|
| 5,135,552 | A | 8/1992 | Weistra | |
| 5,779,745 | A | 7/1998 | Kilstrom | |
| 6,640,385 | B2 * | 11/2003 | Oh et al. | 15/352 |
| 7,162,770 | B2 * | 1/2007 | Davidshofer | 15/353 |
| 2002/0046438 | A1 * | 4/2002 | Oh | 15/353 |
| 2002/0088079 | A1 * | 7/2002 | Oh | 15/352 |
| 2002/0178535 | A1 * | 12/2002 | Oh et al. | 15/352 |
| 2004/0177472 | A1 * | 9/2004 | Go et al. | 15/353 |
| 2006/0218744 | A1 * | 10/2006 | Hayashi et al. | 15/347 |

* cited by examiner

*Primary Examiner*—Theresa T Snider
(74) *Attorney, Agent, or Firm*—King & Schickli, PLLC

(57) ABSTRACT

A vacuum cleaner includes a nozzle assembly and a canister assembly connected to the nozzle assembly. The nozzle assembly includes an inlet. A suction generator is carried on one of the nozzle assembly and canister assembly. A cyclonic separation chamber is carried on one of the nozzle assembly or the canister assembly. The cyclonic separation chamber includes an inlet and first and second outlets. A dirt collection vessel has a dirty air inlet in fluid communication with the first outlet of the cyclonic separation chamber and a discharge outlet in fluid communication with the suction generator.

13 Claims, 4 Drawing Sheets

SELECTIVE BAG OR BAGLESS CLEANING SYSTEM

This application claims the benefit of U.S. Provisional Patent Application Ser. No. 60/445,317 filed on Mar. 17, 2003.

TECHNICAL FIELD

The present invention relates generally to the floor care equipment field and, more particularly, to a selective bag or bagless cleaning system for a vacuum cleaner and upright and canister vacuum cleaners incorporating such a system.

BACKGROUND OF THE INVENTION

Floor care cleaning equipment such as canister vacuum cleaners and upright vacuum cleaners have long been known in the art. Such vacuum cleaners incorporate a fan and motor assembly that generates negative air pressure to draw dirt and debris into the vacuum cleaner. Many incorporate rotary agitators that beat dirt and debris from the nap of an underlying carpet or rug in order to provide additional cleaning action. Entrained dirt and debris is removed from the airstream and collected in a dirt collection vessel such as a dirt cup or dust bag constructed of porous filter material. Some vacuum cleaners rely strictly upon bags or filters to clean the dirt and debris from the airstream while others also utilize cyclonic airflow principles.

The present invention relates to a vacuum cleaner that may be selectively operated to collect dirt in a dirt cup or in a dust bag depending upon the particular preference of the operator.

SUMMARY OF THE INVENTION

In accordance with the purposes of the present invention as described herein, an improved vacuum cleaner is provided. That vacuum cleaner includes a nozzle assembly having an inlet opening. A canister assembly is connected to the nozzle assembly. A suction generator is carried on one of the nozzle assembly or the canister assembly. Additionally, a dirt collection vessel is also carried on one of the nozzle assembly and the canister assembly. The dirt collection vessel includes a top wall, a sidewall and a bottom wall. An air inlet is provided in the top wall and an air outlet is provided in one of the sidewall or the bottom wall.

In accordance with one possible embodiment of the present invention, the dirt collection vessel includes a lid. Further the vacuum cleaner may include an agitator on the nozzle assembly held in the inlet opening.

In accordance with yet another aspect of the present invention, the vacuum cleaner may be described as comprising a nozzle assembly having an inlet opening and a canister assembly connected to the nozzle assembly. A cyclonic separation chamber is carried on either the nozzle assembly or the canister assembly. The cyclonic separation chamber includes an inlet, a first outlet and a second outlet. A dirt collection vessel is also carried on either the nozzle assembly or the canister assembly. The dirt collection vessel has a dirty air inlet in fluid communication with the first outlet of the cyclonic separation chamber. In addition the dirt collection vessel includes a discharge outlet. Still further a suction generator is also carried on the nozzle assembly or the canister assembly.

More specifically describing the invention, the vacuum cleaner includes a discharge conduit in fluid communication with the second outlet, the discharge outlet and an intake of the suction generator. Further a flow control valve is provided in the discharge conduit between the second outlet and the discharge outlet. This flow control valve is displaceable between a first position wherein the discharge outlet is closed off from the suction generator intake and a second position wherein the second outlet is closed off from the suction generator intake.

In accordance with one possible embodiment a dust bag is held in the dirt collection vessel. The dust bag includes an inlet receiving dirty air from the first outlet. The dust bag is made from a material porous to air. In one possible embodiment at least a portion of the dust bag and at least a portion of the dirt collection vessel are transparent so as to allow one to monitor the fill condition of the dust bag during use of the vacuum cleaner.

In accordance with yet another aspect of the invention, an air filter is provided in the discharge conduit downstream from the second outlet. Further, the air filter may be provided upstream of the discharge outlet. Still further describing the invention a dirt filter is provided over the second outlet.

In accordance with one possible embodiment of the invention the cyclonic separation chamber is substantially cylindrical in shape and includes an end wall and a sidewall. The first outlet is located adjacent the sidewall while the second outlet is located adjacent an axial centerline of the cyclonic separation chamber on the end wall. The first outlet may also be provided in the end wall.

The vacuum cleaner of the present invention may also be described as comprising a housing, a cyclonic separation chamber having an inlet and an outlet, a dirt cup in fluid communication with the cyclonic separation chamber and a suction generator in fluid communication with the dirt cup.

In accordance with yet another aspect of the present invention the vacuum cleaner may be described as comprising a housing and a cyclonic separation chamber carried on the housing. The cyclonic separation chamber includes a first inlet, a first outlet and a second outlet. Further, the vacuum cleaner includes a dirt cup having a second inlet in fluid communication with the first outlet. Additionally, the dirt cup includes a third outlet. Still further the vacuum cleaner includes a suction generator having a third inlet in fluid communication with the second outlet and the third outlet. Additionally, the vacuum cleaner includes a valve for selectively controlling airflow between the second and third outlets and the third inlet.

Finally, the vacuum cleaner of the present invention may be described as comprising a housing, a cyclonic separation chamber carried on the housing and a dirt collection vessel separate from but in fluid communication with the cyclonic separation chamber. Additionally, the vacuum cleaner includes a suction generator carried on the housing.

In the following description there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING FIGURES

The accompanying drawings incorporated in and forming a part of the specification, illustrate several aspects of the present invention, and together with the description serve to explain certain principles of the invention. In the drawings.

Reference will now be made in detail to the present preferred embodiment of the invention, an example of which is illustrated in the accompanying drawing.

DETAILED DESCRIPTION OF THE INVENTION

Figure 1:
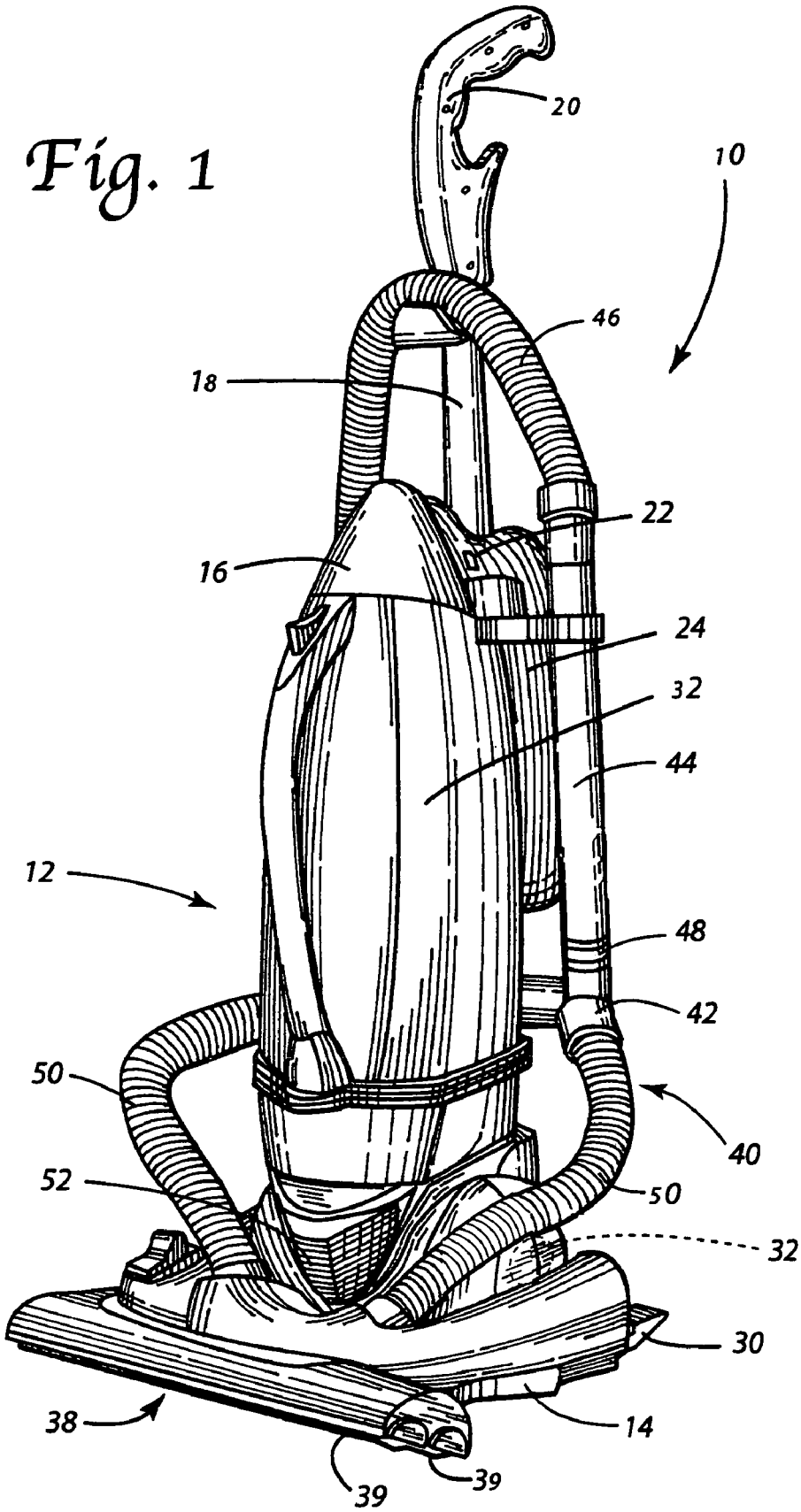
FIG. 1 is perspective view of an upright vacuum cleaner equipped with the selective bag or bagless cleaning system of the present invention.

Reference is now made to FIG. 1 showing an upright vacuum cleaner 10 equipped with the selective bag or bagless cleaning system 12 of the present invention. The upright vacuum cleaner 10 includes a housing comprising a nozzle assembly 14 and a canister assembly 16. The canister assembly 16 further includes a control handle 18 and a hand grip 20. A control switch 22 is provided for turning the vacuum cleaner on and off. Of course, electrical power is supplied to the vacuum cleaner 10 from a standard electrical wall outlet through an electrical cord 24.

A pair of rear wheels (not shown) are provided on a lower portion of the canister assembly 16 and a pair of front wheels (also not shown) are provided on the nozzle assembly 14. Together, these wheels function in a manner known in the art to support the vacuum cleaner for movement across the floor. To allow for convenient storage of the vacuum cleaner 10, a foot latch 30 functions to lock the canister assembly 16 in an upright position as shown in FIG. 1. When the foot latch 30 is released, the canister assembly 16 may be pivoted relative to the nozzle assembly 14 as the vacuum cleaner 10 is manipulated back and forth to clean the floor.

In the present preferred embodiment, the canister assembly 16 includes a cavity adapted to receive and hold the selective bag and bagless cleaning system 12 that will be described in greater detail below. A suction generator 32, including a fan and drive motor assembly, is carried on the canister assembly 16 and functions to generate a vacuum airstream for drawing dirt and debris from a surface to be cleaned. The suction generator 32 may be carried on the canister assembly 16 as illustrated or on the nozzle assembly 14 if desired.

The nozzle assembly 14 includes an inlet opening 38 that houses a pair of agitators 39 that are rotated by the motor of the suction generator 32 or a separate, dedicated motor relative to the nozzle assembly. The main inlet opening 38 of the nozzle assembly 14 is provided in fluid communication with the selective bag or bagless cleaning system 12 by means of an airflow system generally designated by reference numeral 40. That airflow system includes hoses 50, a substantially T-shaped fitting 42, a wand 44 and a flexible hose 46. During floor cleaning, the cleaning end 48 of the wand is inserted and held in the fitting 42. Accordingly, the suction generator 32 draws air and entrained dirt and debris through the inlet opening 38, the twin hoses 50, the fitting 42, then up the wand 44 and through the flexible hose 46 for delivery to the inlet 208 of the selective bag or bagless cleaning system 12 (see also FIGS. 3*a* and 3*b*). Dirt and debris is collected in the selective bag or bagless cleaning system 12 in a manner described in greater detail below. The clean air is then passed over the motor of the fan and motor assembly to provide cooling and then discharged through a HEPA filter (not shown) and an exhaust port 52 into the environment.

Figure 2:
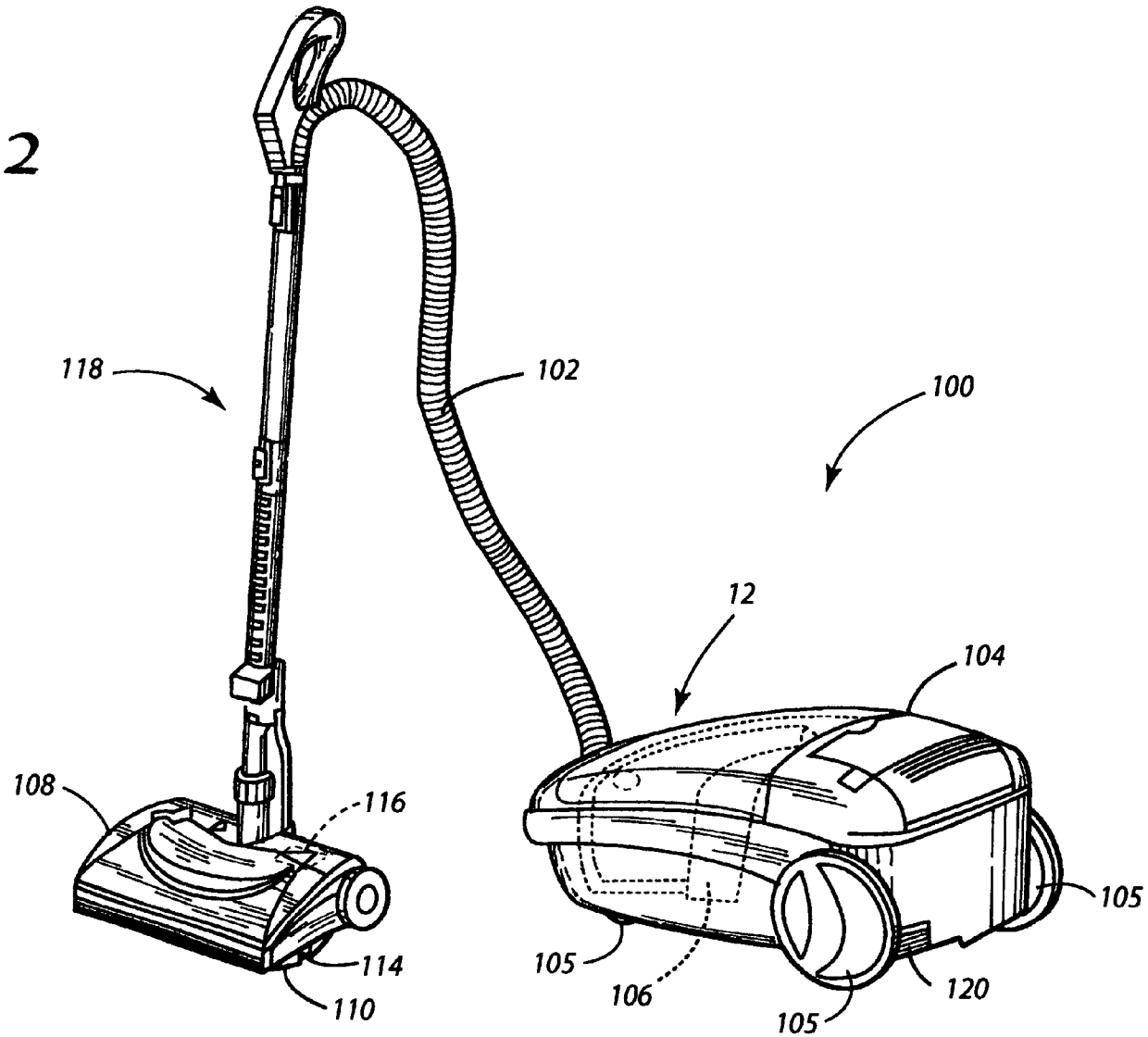
FIG. 2 is a perspective view of a canister vacuum cleaner also equipped with such a system.

FIG. 2 illustrates a canister vacuum cleaner 100 equipped with the selective bag or bagless cleaning system 12 of the present invention. More particularly, the canister vacuum cleaner 100 includes a hose 102 and a canister housing 104. The canister housing 104 carries the selective bag or bagless cleaning system 12 of the present invention. A suction generator, in the form of a fan and motor assembly generally designated by reference numeral 106 is also carried in the canister housing 104 on wheels 105.

The vacuum cleaner 100 also includes a nozzle 108 for picking up dirt and debris. The nozzle 108 includes an inlet 110. The nozzle 108 houses a motor driven agitator 114 and a drive motor 116 for driving the agitator. A telescoping wand assembly generally designated by reference numeral 118 operatively connects the nozzle 108 to the hose 102 that is connected to the canister housing 104. Air entrained with dirt and debris is drawn by the suction generator 106 through the inlet 110 in the nozzle 108 as well as the wand 118 and hose 102 to the selective bag or bagless cleaning system 12. The dirt and debris is then collected from the air in that system 12 and the clean air then flows over the motor of the suction generator 106 to provide cooling for the motor. The air is then subject to final filtration through a HEPA filter before being exhausted into the environment through the exhaust vent 120.

The selective bag or bagless cleaning system 12 of the present invention will now be described in detail with reference to FIGS. 3*a* and 3*b*. As illustrated, the selective bag or bagless cleaning system 12 includes a cyclonic airflow chamber 200 of cylindrical shape comprising a first end wall 202, a sidewall 204 and a second end wall 206. A tangentially directed inlet 208 is provided in the sidewall 204. A first outlet 210 is provided in the end wall 206 adjacent the sidewall 204. A second outlet 212 is provided in the end wall 206 adjacent the axial center line of the cylindrical separation chamber 200. A removable dirt collection vessel in the form of a transparent dirt cup 214 is mounted in a cavity 216 of the selective bag or bagless cleaning system 12. The dirt cup 214 includes a first end wall 218, a sidewall 220 and a second end wall 222. A dirty air inlet 224 is provided in the end wall 218 in fluid communication with the first outlet 210 leading from the cyclonic separation chamber 200. A discharge outlet 226 is provided in the sidewall 220. A screen or other filtering member 228 covers the discharge outlet 226. A similar screen 230 or other suitable filtering material covers the second outlet 212 of the cyclonic separation chamber 200.

The selective bag or bagless cleaning system 12 further includes a discharge conduit 232. The second outlet 212 of the cyclonic separation chamber 200 is provided in fluid communication with the discharge conduit 232. Similarly, the discharge outlet 226 of the dirt cup 214 is provided in fluid communication with the discharge conduit 232.

As further illustrated, a removable air filter 234 is received in the discharge conduit 232 or a manifold forming a part of the discharge conduit downstream from the second outlet 212 leading from the cyclonic separation chamber 200. As illustrated, that filter 234 is positioned in the discharge conduit 232 upstream from the discharge outlet 226. It should be appreciated, however, that the filter 234 could be positioned downstream from the discharge outlet 226 in the discharge conduit 232 if desired.

A flow control valve, generally designated by reference numeral 236 is also provided in the discharge conduit 232.

Figure 3A:
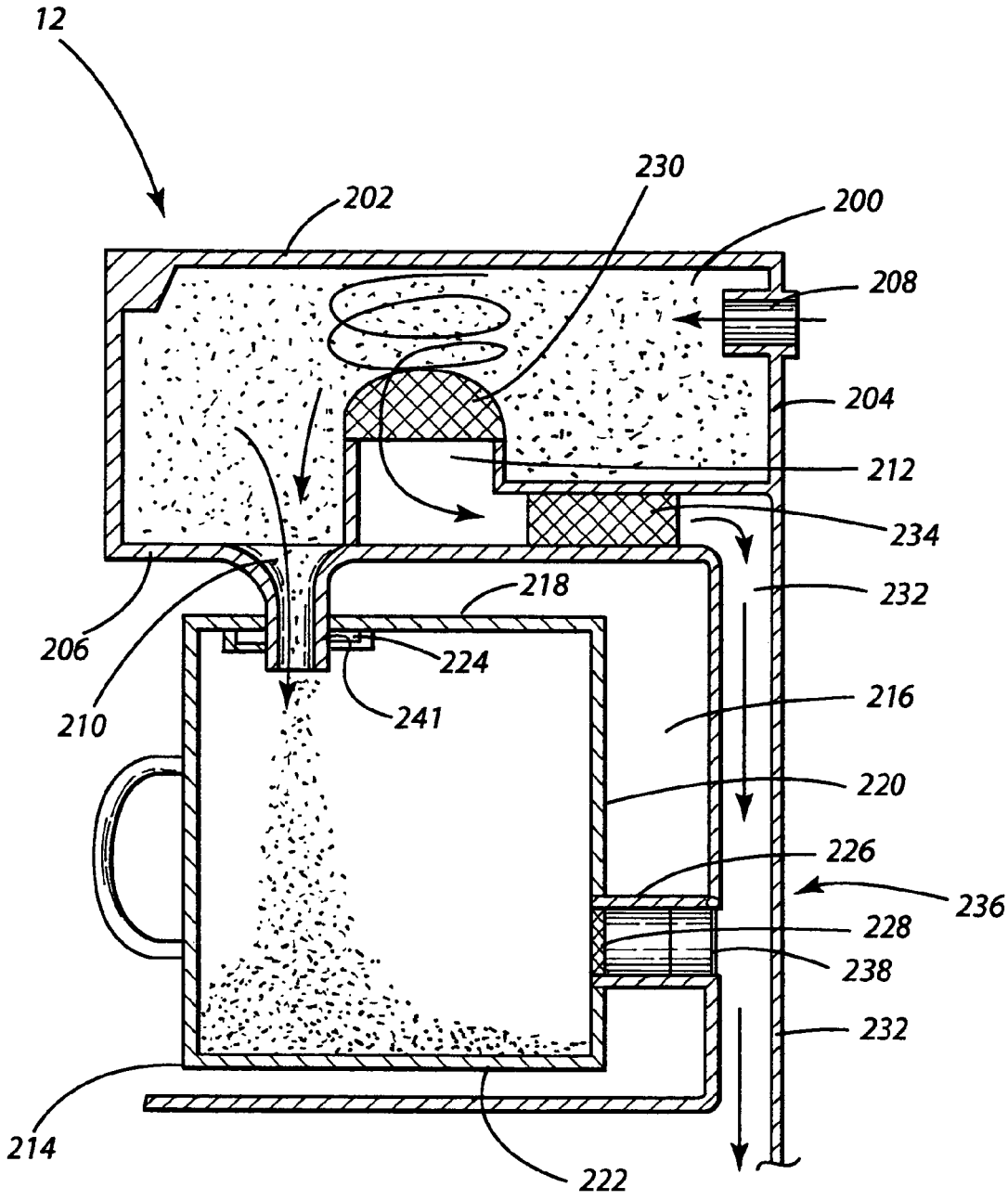
FIGS. 3*a* and 3*b* are schematical representations showing the details of the selective bag or bagless cleaning system of the present invention.
Figure 3B:
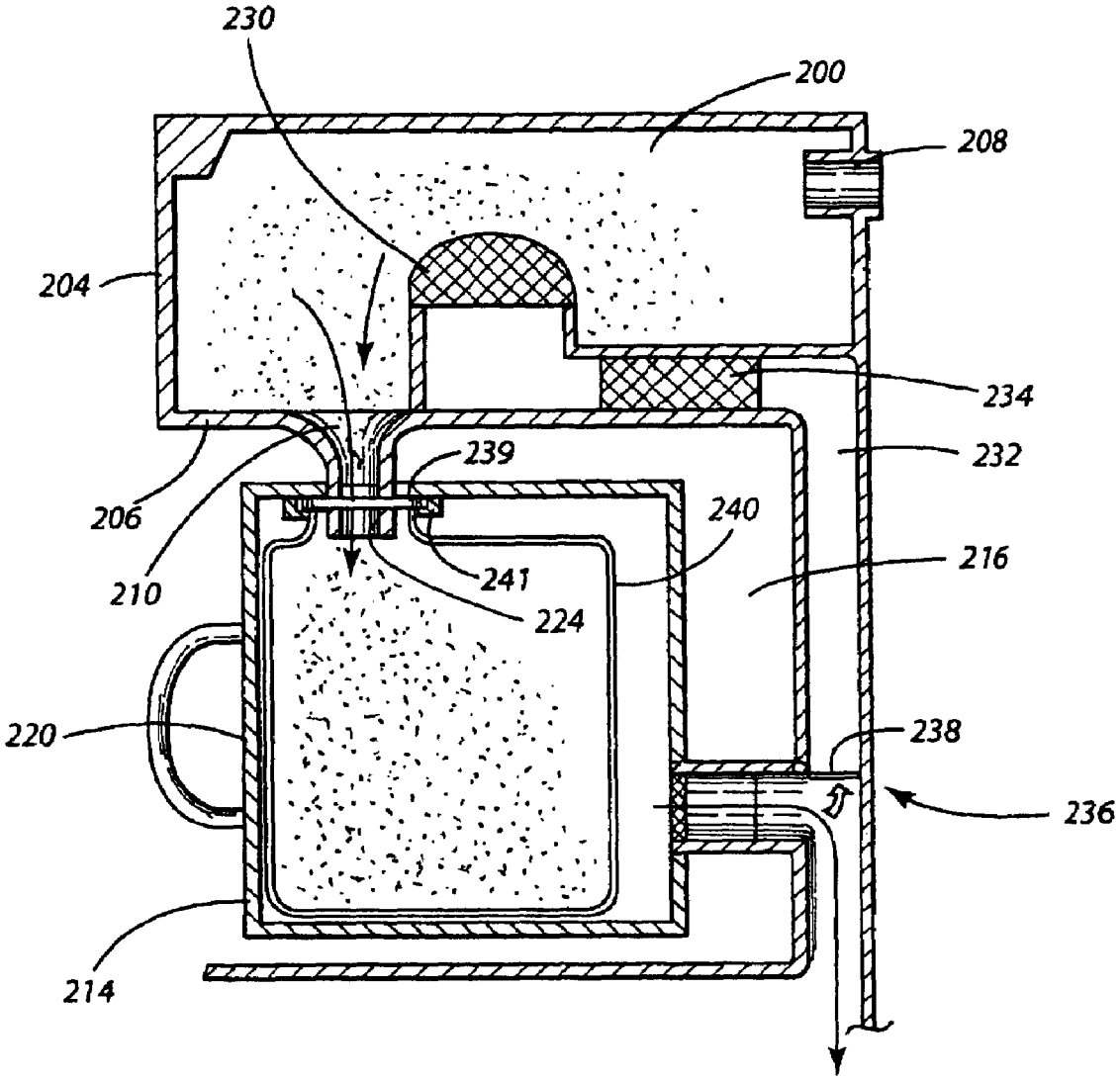

As illustrated, the flow control valve 236 is a flap valve having a flap 238 selectively displaceable between a first position shown in FIG. 3*a* and a second position shown in FIG. 3*b*. In the first position shown in FIG. 3*a*, the flow control valve 236 interrupts flow from the discharge outlet 226 and allows flow from the second outlet 212 through the discharge conduit 232. In the second position shown in FIG. 3*b*, the flap 238 of the flow control valve 236 interrupts flow from the second outlet 212 while allowing flow from the discharge outlet 226 through the discharge conduit 232. As should be appreciated, the airflow is established by the fan and motor assembly of the suction generator 32 which has an intake connected to the downstream end of the discharge conduit 232.

The operation of a vacuum cleaner 10, 100 incorporating the selective bag or bagless cleaning system 12 of the present invention will now be described in detail.

Bagless Operation

When the flow control valve 236 is in the first position illustrated in FIG. 3*a*, the rotary agitator or agitators 39, 114 beat dirt and debris from the nap of an underlying rug or carpet to be cleaned. That dirt and debris is entrained in an airstream drawn into the inlet opening of the nozzle assembly 14, 108 by the suction generator 32, 106.

That airstream including the entrained dirt and debris is then delivered into the cyclonic separation chamber 200 through the tangentially directed inlet 208. As that airstream spins in the cylindrical chamber 200 dirt and debris entrained in the airstream are forced by centrifugal forces toward the sidewall 204. The dirt and debris is then forced from the cyclonic separation chamber 200 through the first outlet 210 adjacent the sidewall 204. The first outlet 210 is provided in fluid communication with the dirty air inlet 224 of the dirt cup 214. Thus, dirt and debris passing through the outlet 210 is collected in the dirt cup 214. In order to insure the free flow of dirt and debris into the dirt cup 214, some restricted flow of air may be allowed to pass through or past the flap 238. Thus, the flap 238 may include an orifice of limited cross sectional area or the flap seat in the discharge outlet 226 may include a stop that prevents the flap from fully closing the outlet.

Due to the cyclonic cleaning action of the airstream, clean air flows toward the axial center line of the cyclonic separation chamber 200. That clean air is drawn through the screen 230 covering the second outlet 212.

The screen 230, of course, insures that no larger particles of dirt are ingested by the discharge conduit 232. The air then passes along the discharge conduit 232 and through the filter 234 provided in that conduit before moving past the flow control valve 236 and on to the intake of the fan of the suction generator 32, 106. That clean air then flows over the fan motor to provide desired cooling and then is filtered through a HEPA filter before being exhausted to the environment.

Bag Operation

Often due to operator preference or as a result of the particular cleaning application a user may find it desirable to collect dirt and debris in a dirt bag rather than a dirt cup 14. Advantageously, a vacuum cleaner 10, 100 equipped with the selective bag or bagless cleaning system 12 of the present invention allows for conversion between bag or bagless (dirt cup) cleaning with the simple insertion of a bag 240 in the dirt cup 214 and flip of a control valve 236.

More particularly, as shown in FIG. 3*b*, a dirt bag 240 constructed from porous filter material of a type known in the art may be held in the dirt cup 214 by means of a cardboard collar 239 received in a mounting frame 241. The dirt bag 240 has an inlet that is connected over and provided in fluid communication with the first outlet 210 leading from the cyclonic separation chamber 200.

For purposes of bag operation, the flow control valve 236 is placed in the second position so as to restrict or interrupt flow through the second outlet 212 and establish flow through the discharge outlet 226. Accordingly, air and entrained dirt and debris delivered to the inlet 208 of the cyclonic separation chamber 200 is routed through the first outlet 210 into the dirt bag 240. The material from which the dirt bag 240 is constructed serves to collect dirt and debris inside the dirt bag while allowing clean air to pass through the pores of the material and escape from the dirt bag. That air is then drawn through the discharge outlet 226 into the discharge conduit 232 where it passes the flow control valve 236 and is delivered to the intake of the suction generator 32, 106. The clean air passes over the motor providing the desired cooling, then it is finally filtered through a HEPA filter and exhausted into the environment.

If desired, some restricted flow of clean air may be allowed past the flap 238 through the outlet 212. More specifically, the flap 238 could include an orifice of limited cross-sectional area or a stop may be provided to prevent the flap from fully closing the discharge conduit 232 upstream from the discharge outlet 226.

Whether the dirt and debris is collected strictly in the dirt cup 214 alone or the dirt bag 240 in the dirt cup 214, it will eventually become necessary to empty the collected dirt and debris into a trash receptacle.

This is done by releasing a latch (not shown) and sliding, pulling or otherwise removing the dirt cup 214 from the cavity 216 of the selective bag or bagless cleaning system 12. The dirt cup 214 may be made so that the end wall 218 may be completely removable or connected by a hinge (not shown) to the sidewall 220. Once the "lid" 218 is removed or opened the dirt and debris or, depending on the operating mode, the dirt bag 240 filled with dirt and debris may be dumped from the dirt cup 214 into the trash receptacle without any direct handling. It should also be appreciated that the filter 234 may be removed from the discharge conduit 232 and replaced as necessary.

The foregoing description of the preferred embodiment of the invention has been presented for purposes of illustration and description. It is not intended to be exhaustive or to limit the invention to the precise form disclosed. Obvious modifications or variations are possible in light of the above teachings. For example, the dirt bag 240 could be made to include at least a portion made from a transparent material. This will allow a viewing window for the operator to visually confirm the filling of the dirt bag during the course of the cleaning operation. Further, instead of opening at the top, the end wall 222 could be connected by a hinge and latch to the sidewall 220.

The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiment do not and are not intended to limit the ordinary meaning of the claims and their fair and broad interpretation in any way.

The invention claimed is:

1. A vacuum cleaner, comprising:

a nozzle assembly having an inlet opening;

a canister assembly connected to said nozzle assembly;

a cyclonic separation chamber having an inlet, a first outlet and a second outlet, said cyclonic separation chamber being carried on one of said nozzle assembly and said canister assembly;

a dirt collection vessel having a dirty air inlet and a discharge outlet, said dirt collection vessel being carried on one of said nozzle assembly and said canister assembly; and a suction generator carried on one of said nozzle assembly and said canister assembly;

wherein said dirty air inlet is in fluid communication with said first outlet and said second outlet bypasses said dirt collection vessel and a discharge conduit is provided in fluid comminication with (a) said second outlet, (b) said discharge outlet and (c) an intake of said suction generator.

2. The vacuum cleaner of claim 1 wherein an air filter is provided in said discharge conduit downstream from said second outlet.

3. the vacuum cleaner of claim 2, wherein said air filter is upstream of said discharge outlet.

4. The vacuum cleaner of claim 1, including a dirt filter over said second outlet.

5. The vacuum cleaner of claim 1, wherein said cyclonic separation chamber is substantially cylindrical in shape and includes an end wall and a sidewall, said first outlet being located adjacent said sidewall and said second outlet being located adjacent an axial centerline of said cyclonic separation chamber on said end wall.

6. The vacuum cleaner of claim 5, wherein said first outlet is also in said end wall.

7. The vacuum cleaner of claim 1 further including an agitator on said nozzle assembly held in said inlet opening.

8. A vacuum cleaner, comprising:

a nozzle assembly having an inlet opening;

a canister assembly connected to said nozzle assembly;

a cyclonic separation chamber having an inlet, a first outlet and a second outlet, said cyclonic separation chamber being carried on one of said nozzle assembly and said canister assembly;

a dirt collection vessel having a dirty air inlet in fluid communication with said first outlet and a discharge outlet, said dirt collection vessel being carried on one of said nozzle assembly and said canister assembly;

a suction generator carried on one of said nozzle assembly and said canister assembly;

a discharge conduit in fluid communication with (a) said second outlet, (b) said discharge outlet and (c) an intake of said suction generator; and a flow control valve in said discharge conduit between said second outlet and said discharge outlet.

9. The vacuum cleaner of claim 8, wherein said How control valve is displaceable between a first position wherein said discharge outlet is closed off from said suction generator intake and a second position wherein said second outlet is closed off from said suction generator intake.

10. The vacuum cleaner of claim 9, further including a dust bag held in said din collection vessel, said dust bag including an inlet receiving dirty air from said first outlet.

11. The vacuum cleaner of claim 10, wherein said dust bag is made from a material porous to air.

12. The vacuum cleaner of claim 10, wherein at least a portion of said dust bag and at least a portion of said dirt collection vessel are transparent.

13. A vacuum cleaner, comprising:

a housing;

a cyclonic separation chamber carried on said housing, said cyclonie separation chamber including a first inlet, a first outlet and a second outlet;

a dirt cup having a second inlet in fluid communication with said first outlet and a third outlet; and a suction generator having a third inlet in fluid communication with said second outlet and said third outlet; and a valve for selectively controlling airflow between (a) said second and third outlets and (b) said third inlet.

* * * * *

UNITED STATES PATENT AND TRADEMARK OFFICE

CERTIFICATE OF CORRECTION

PATENT NO. : 7,343,643 B2
APPLICATION NO. : 10/802966
DATED : March 18, 2008
INVENTOR(S) : Yasushi Kondo It is certified that error appears in the above-identified patent and that said Letters Patent is hereby corrected as shown below:

Claim 9, column 8, line 16, please replace “How” with -- flow --.

Claim 13, column 8, line 32, please replace “cyclonie” with -- cyclonic --.

Signed and Sealed this

Seventeenth Day of June, 2008

JON W. DUDAS
*Director of the United States Patent and Trademark Office*